US005577335A

United States Patent [19]

Tucker

[11] Patent Number: 5,577,335

[45] Date of Patent: Nov. 26, 1996

[54] MEDICATION COMPLIANCE SYSTEM WITH MED-DIAL, MED-PROFILE, EASEL AND OPTIONAL VISUAL HANDICAP AIDS

[76] Inventor: Annabelle D. Tucker, 4480 Sherman Oaks Cir., Sherman Oaks, Calif. 91403

[21] Appl. No.: 348,479

[22] Filed: Dec. 2, 1994

Related U.S. Application Data

[63] Continuation-in-part of Ser. No. 754,045, Sep. 3, 1991, Pat. No. 5,149,047, and Ser. No. 11,453, Aug. 5, 1993, Pat. No. Des. 370,628.

[51] Int. Cl.[6] ..... G09F 3/08

[52] U.S. Cl. ..... 40/311; 116/309

[58] Field of Search ..... 116/308, 309, 116/307; 283/900; 40/311, 310, 495, 299

[56] References Cited

U.S. PATENT DOCUMENTS

| | | | |
|---|---|---|---|
| 135,092 | 1/1873 | DeBarry | 116/308 X |
| 398,012 | 2/1889 | Weaver | 116/308 |
| 623,171 | 4/1899 | Mowry | 116/308 |
| 1,211,737 | 1/1917 | Martini | 116/308 |
| 3,606,695 | 9/1971 | Robbins | 40/495 |
| 4,041,628 | 8/1977 | Sasson | 40/495 X |
| 4,419,016 | 12/1983 | Zoltan | 283/900 X |
| 4,614,360 | 9/1986 | Sheehan et al. | 283/900 X |
| 4,905,388 | 3/1990 | Sinkow | 283/900 X |
| 4,913,083 | 4/1990 | Valvo et al. | 40/311 X |
| 5,031,937 | 7/1991 | Nellhaus | 283/900 X |
| 5,046,609 | 9/1991 | Mangini et al. | 40/310 X |
| 5,431,450 | 7/1995 | Coleman | 283/900 X |

*Primary Examiner*—Joanne Silbermann

[57] ABSTRACT

A compliance system is described to help patients organize and comprehend multiple or single medication and treatment schedules. Containers for prescribed and over-the-counter drugs are numbered to coordinate with a numbered medication listing and medication profile. The numbered medication listing is made visible on an easel structure that also comprises large master dials whose faces have time or day indicia imprinted and an attached anchor on which a perforated pointer is seated to rotate relative to each other. Optional magnet master dials are provided for other visible places, such as the refrigerator door, to alert to schedule compliance time or day. The numbered containers are provided with small dials, imprinted with time or day indicia, that are perforated to seat on the adhesive anchor arrow indicator to rotate relative to each other. The dials are digitally advanced to the next treatment due time after each procedure is completed to reassure or remind of Schedule compliance and to avoid double dosing a medication. The simplified compliance system can help save time and phone calls in dispensing the required verbal and written drug information by providing a medication profile form and the organized teaching tools to help the patient comprehend the schedule and reinforce the verbal consultations with the system's medication profile.

10 Claims, 8 Drawing Sheets

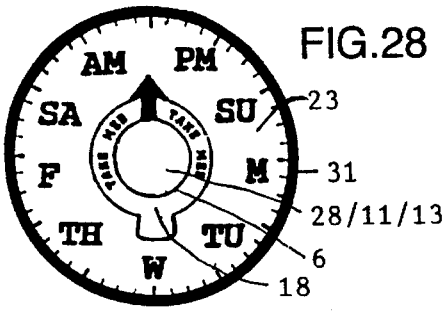
FIG.28
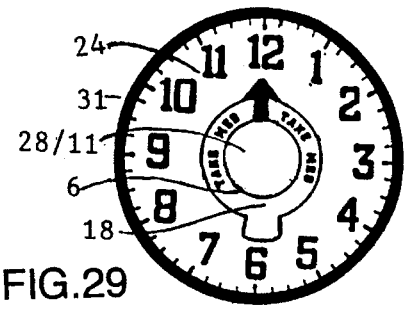
FIG.29
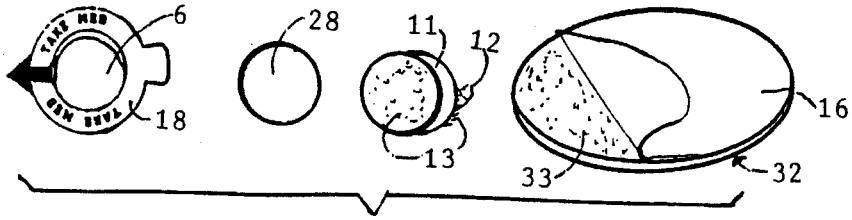
FIG.30
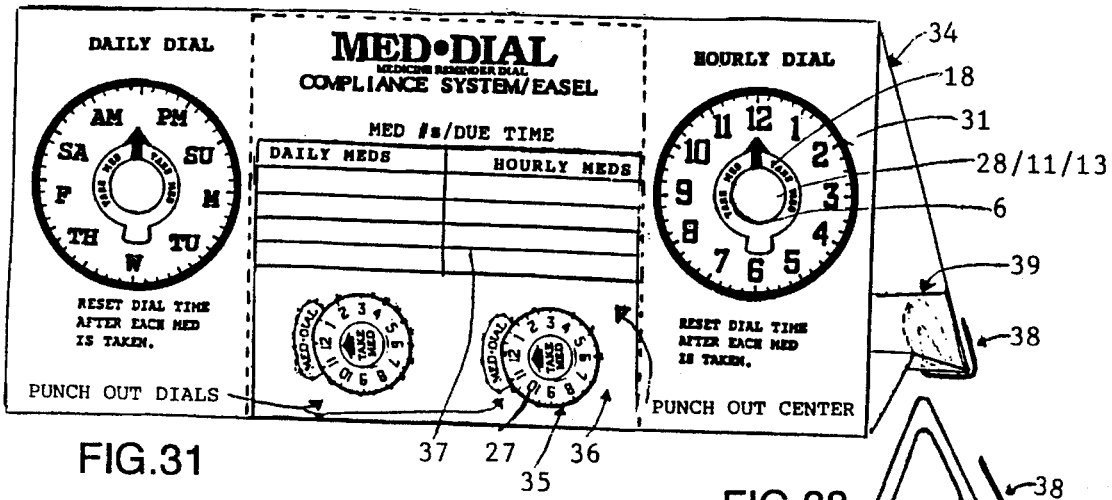
FIG.31
FIG.33
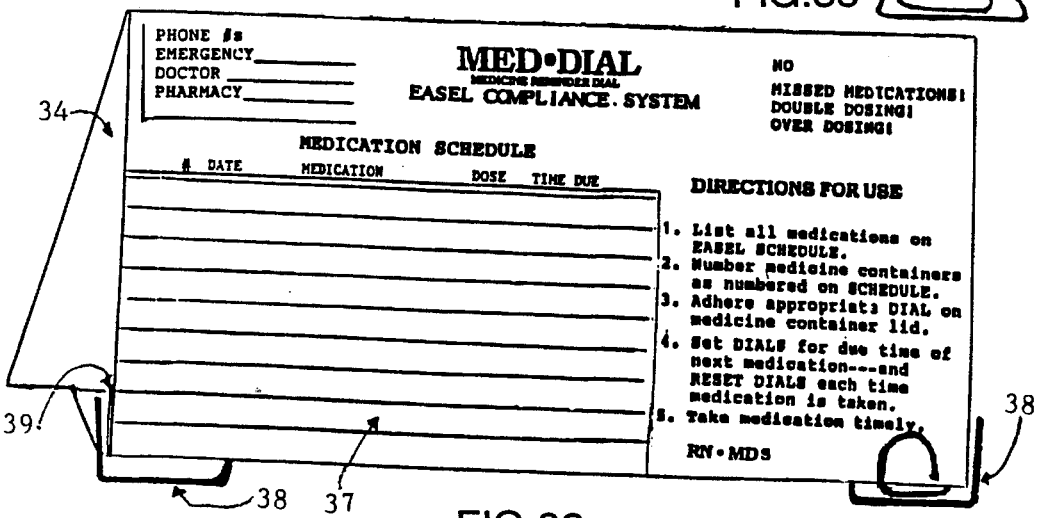
FIG.32

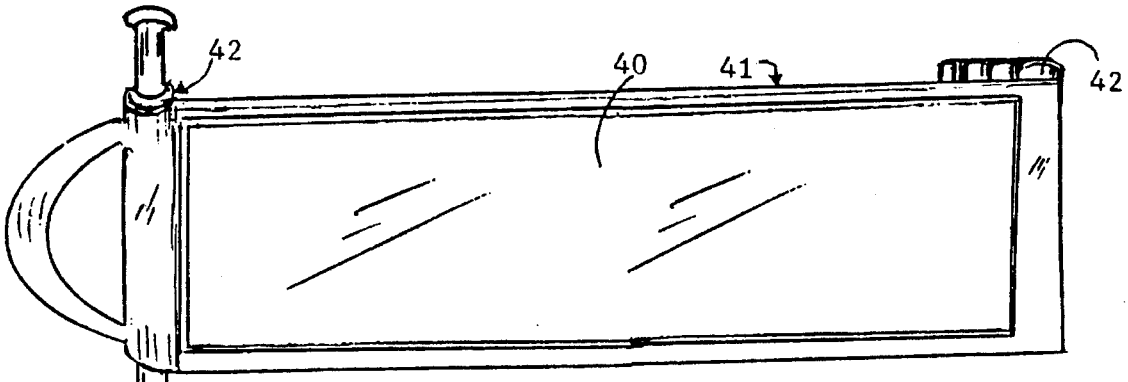
FIG.34
FIG.35
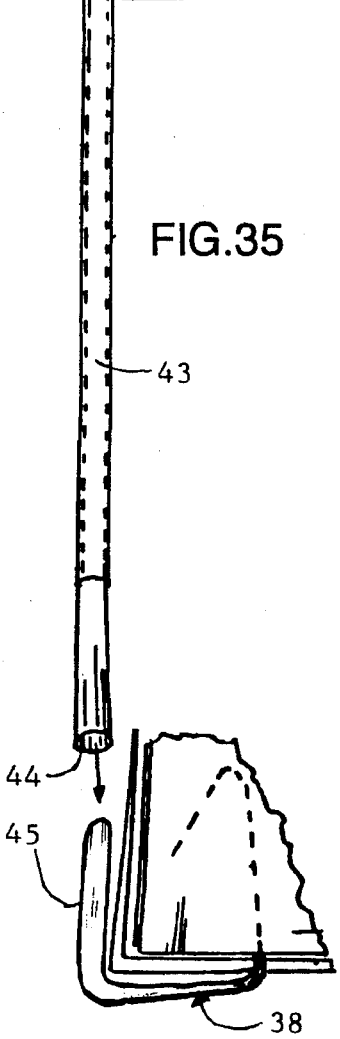
FIG.36
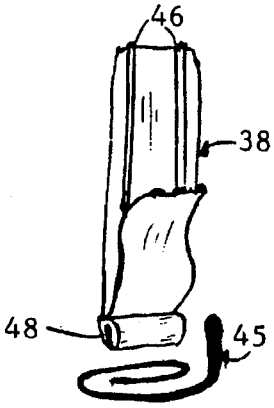
FIG.37
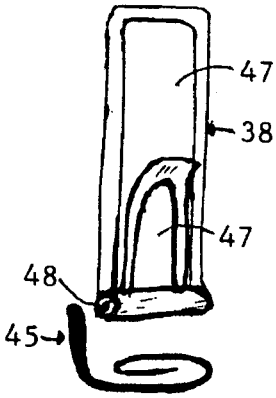
FIG.38
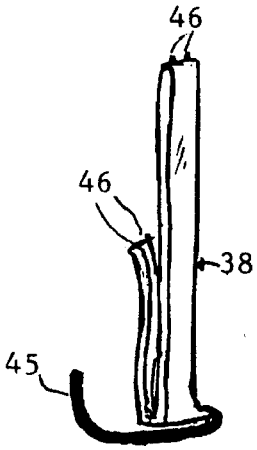
FIG.39

MEDICATION COMPLIANCE SYSTEM WITH MED-DIAL, MED-PROFILE, EASEL AND OPTIONAL VISUAL HANDICAP AIDS

PRIOR APPLICATION INFORMATION

This application is a continuation-in-part of application Ser. No. 07/754,045, filed Sep. 3, 1991 (issued) now U.S. Pat. No. 5,149,047, and is a continuation-in-part of application Ser. No. 29/011,453 filed Aug. 5, 1993 (in action) now U. S. Pat. No. Des. 370,628.

The Disclosure Documents are #331,655 filed May 21, 1993; #339,137 filed Sep. 14, 1993; #341,428 filed Oct. 25, 1993; #354,759 filed May 25, 1994; #356,990 filed Jun. 29, 1994; #357,654 filed Jul. 11, 1994 and #362,887 filed Oct. 11, 1994, and #324,115 filed Feb. 2, 1993 and #333,030 filed Apr. 26, 1993.

FIELD OF INVENTION

The present invention relates to the field of medical systems. Specifically, the present invention relates to the apparatus used to teach, to organize and to comprehend medication and treatment scheduling to help prevent missing medication doses, double dosing medications or stopping medications due to the patient's confusion. Non-compliance to treatment can endanger the patient or slow healing, increasing the cost of healthcare. Non-compliance, particularly in antibiotic schedules, can allow bacteria to become resistant to the treatment. That altered bacteria can be a universally untreatable threat. Non-compliance is misuse and abuse of medications, prescribed and over-the-counter, that can lead to expensive addiction problems that later need the help of drug treatment centers.

BACKGROUND OF THE INVENTION

Cost-effecting healthcare has lead to the early discharge of hospital patients and to out-patient clinic care. Many, vulnerably isolated, patients are seniors, on multiple medications. They are in danger of becoming confused, missing medication doses, double dosing and possibly stopping treatment prematurely. The misuse and abuse of prescribed and over-the-counter drugs is a problem that even crosses the line to all consumer age groups.

Information about medications, potential adverse reactions, related diet and activity, drug interactions, etc., is readily available from the pharmacist----but the patient must know what to ask, so they can better comprehend their particular treatment schedule. The patients need a verbal and written consult to enhance comprehension and later recall, if a problem arises.

Some medications have containers that provide indicia on the cap that is automatically advanced to show the next medication due time when the cap is replaced. Automating the procedure may inhibit mind-setting the schedule that is essential to compliance. A watch timed alarm may be more helpful but they are expensive and may be confusing to activate, especially for the senior patient. There are many kinds of medication sorting boxes on the market that require a transfer of medications from their original container, chancing a mix-up of multiple medication schedules. While prior art devices provide some help in complying with prescribed treatments, they are limited and often complex. The double check on medication schedules is visibly lacking and is needed to assure compliance.

Non-compliance to medication treatment is a very serious problem according to the NATIONAL COUNCIL ON PATIENT INFORMATION AND EDUCATION and THE BOARD OF PHARMACY. They tell us that over half of the 36 million Americans, over the age of 60, are taking one or more prescribed medications and taking them incorrectly. When several medications are combined, the chance of adverse reaction is increased, confuse the scheduling and chance missing medication doses. A simple, double check, visible system is very much needed to help consumers mind set their medication schedules and help assure compliance to prescribed treatment. It is cost-effective to the consumer and to the healthcare system.

The present invention relates to a medication compliance system that comprises a medication profile, an optional magnified easel with medication timing master dials and numbered medication schedule form with separate small time or day indicia imprinted dials for the numbered medication containers. The dials may be modified for the visually handicapped by adding peripheral protrusions to the dials that correspond with the imprinted indicia. The system is intended to simplify organizing and comprehending medication and treatment schedules for the elderly, the young and even the visually handicapped consumer. One look or feel of the dial that is advanced after each medication is taken is a reminder or reassurance that medications were timely taken. The simple dial is digitally eye-set to help mind-aet the medication schedule and avoid missing medication doses that chances double dosing medications that is a danger to the patient. Mixing up on medication schedules can initiate confusion causing the patient to stop treatment and possibly be admitted for hospital or nursing home care, if elderly.

SUMMARY OF THE INVENTION

It is an object of the present invention to provide consumers of prescribed and over-the counter medications a simple, double check, visibly imprinted system to help in compliance with prescribed treatments, deterring misuse and abuse of medications.

Another object of the present invention is to provide a compliance system for prescribed treatment plans that can help patients organize, comprehend and monitor their procedures. A system that can be initiated by the Clinician, Pharmacist, family or self to help deter adverse treatment reactions, to monitor body functions and to visually reassure or remind the patient of their medication or treatment schedule compliance.

A feature of the present invention provides a patient medication profile of all their prescribed and over-the-counter medications that is completed and updated by the Clinician or Pharmacist to include the name of the medication, how often and for how long the medication is to be taken, the purpose of the medication or treatment, how best to take the medication and when, the food or drink that may interact with the medication, the other drugs that may interact with their drug, what possible side effects to watch for and what action to take if they do occur, alternate choices of treatment or medications, activity limitation while taking the drug and the potential of becoming addicted to the drug.

A further feature of the present invention provides visible numbered medication schedules, emergency contacts and master dials, imprinted with time and day indicia, comprising a pointer seated on an attached anchor to rotate relative to each other when pointer is digitally rotated to alert the next medication or treatment scheduled time, after each procedure is completed. The pointer is perforated to seat on the outer body of the adhesive anchor and provides a grip tab to assist rotation.

Another feature of the present invention provides an easel structure to elevate the master dials and schedule imprint, made more visible with an attached magnifier that seats on the page clips that may support the medication profile for easier viewing especially for the senior or visibly handicapped patient.

An additional feature of the present invention alternately provides a magnet backed card comprising imprinted time or day indicia on dials whose pointer is seated on an attached anchor for digital rotation relative to each other and may include the compliance system directions or numbered medication schedule along with emergency phone numbers. The magnet or adhesive backed card may be attached to the refrigerator door or other visible place.

Also a feature of the present invention provides number labels for attachment to medication containers to coordinate the numbers on the medication schedules with the matching medication container as a double check when complying with the prescribed treatment.

A further feature of the present invention provides smaller time and day indicia imprinted dials to attach to the top or side of a medication container or other container that provides a tab on its outer periphery to enhance digital rotation of a dial whose perforation is seated resistantly rotatable onto an attachable anchor, for the dial to be rotated relative to each other when the perforated dial part is rotated to indicate the next medication time, indicated by the arrow imprint on the cap adhered to the top surface of the double coated adhesive foam or other soft material anchor for the dial. The soft material of the anchor allows adhereing to the uneven surface of a medication container cap and provide a grip for the smaller diameter perforation in the body of the indicia dial to grippably rotate and yet deter accidental rotation to disturb the schedule indicated, when seated onto the outer periphery of the body of the anchor.

Another feature of the present invention provides an alternate dial imprinted with time or day indicia that is viewed through a window in the cap cover attached to the adhesive double coated anchor for a medicine or other container with the peripherally tabbed imprint dial perforation seated on the stationary adhesive anchor for rotation relative to each other when the peripheral tab is gripped to rotate the imprinted dial around the outer elevated body of the anchor.

An additional feature of the present invention provides the larger cover cap for the dial with the view window that comprises peripheral tabs that correspond with the inner indicia imprinted face with the window opening at the twelve and the tabs at three, six and nine and the reset tab on the imprinted face extends at the twelve mark. As the reset tab is advanced to the three tab in the cover the three will show in the view window and can be digitally felt to orient the visually handicapped to the schedule time that was set after the prior medication or treatment compliance.

An alternate feature of the present invention is the use of an eyelet to anchor the dial assembly with adhesive foam applied to the base of the structure making the indicia imprinted dial face stationary and the windowed cover providing the reset tab for rotating the cover and the dial imprinted face providing the digital time orientation, with a peripheral protrusion at the twelve o'clock point to assist the visually handicapped.

A further feature of the present invention is an optional, additional AM/PM pointer dial that is perforated to seat onto the foam anchor or held by the eyelet anchor to allow a toggle or rotation of the pointer to indicate the desired indicia which is reset after each procedure, and is a reminder that procedure was complied with or is due.

Another feature of the present invention is the optional use of the hourly indica or an AM/PM daily indicia imprinted dial face with the foam anchor button that may be reused by asking the pharmacist for the same size medication container and exchanging the cap to comply with the prescribed time or day schedule. The Dial that is eyelet anchored is stationary but the caps may be interchanged to comply with the new schedule and thus is reusable.

An additional feature of the present invention provides a magnifying bubble to seat into the view window of the large cover cap that adheres to the top surface of the adhesive anchor to enhance view of the indicia of the dial face.

A further feature of the present invention provides an alternate to the number labeling of schedule coordinated with the medication container number that comprises a color coding label for the system.

Also a feature of the present invention provides separate master larger dials that may be anchored with double coated adhesive foam or eyelet and provide a magnet and or adhesive back to visibly display on the refrigerator door or other convenient place. The dials may provide a cover cap with a view window for indicia, adhered to the top surface of the anchor or be anchored within the eyelet assembly. The dial may have an open indicia imprinted face with the pointer arrow being imprinted on the small cap atop the foam adhesive anchor, the cap being the same diameter of the anchor top and both being a slightly larger diameter than the perforation in the rotatable face of the dial to grippably rotate relative to each other.

An additional feature of the present invention provides a small perforation in the reset tab or other peripheral protrusion to assist arthritic hands in rotating the dial with a semi-pointed object.

Another feature of the present invention provides an adhesive dial with a stationary indicia imprinted face that is adhesive backed and covered with a protective sheet that is peeled off before applying to a container and comprises an anchor for a pointer that is perforated to seat rotatably on, the body of the elevated anchor. The pointer is reset after each procedure and may be used to monitor a Patient's output by setting the pointer to the time patient emptied their bladder or when an indwelling catheter collection bag was emptied. One look at dial time can alert to kidney shutdown if there is no output recorded in a specified time frame, or initiate check for a catheter kink or other obstruction that could create a problem.

An additional feature of the present invention provides a page clip for the easel structure that comprises the master dials and numbered schedule, to hold appointment cards with an extention from the body of the clip.

Further features and advantages of this invention will become more apparent from the following description, the appended claims thereto, and the drawings.

Figure 3:
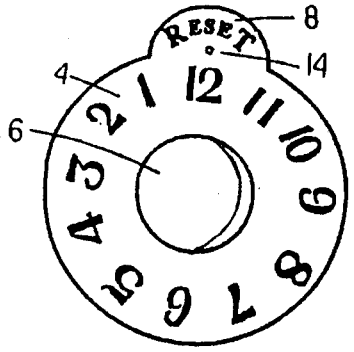

FIG. 3 shows the inner clock-like face dial with central, large perforation that rotates on side surface of the foam anchor disc and the reset tab with small perforation to allow moving reset tab with a grippable, pointed rod.

Figure 4:
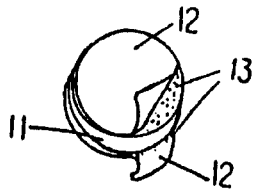

FIG. 4 shows the double coated adhesive foam pad that anchors the top window cover of the invention to the cap of a medication container while the inner face disc is seated onto the body of the foam pad through the large central perforation.

Figure 5:
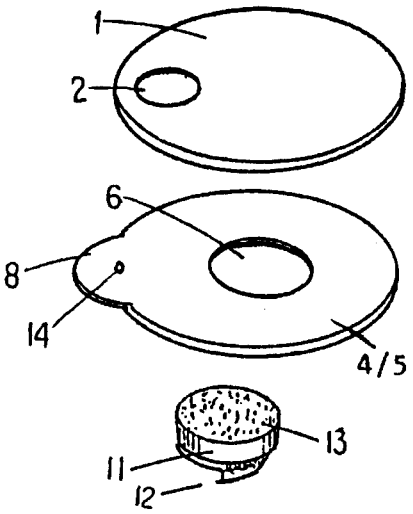

FIG. 5 shows an exploded view of the medication dial parts in perspection with the protective cover of the adhesive pad top removed and ready for assembly.

Figure 6:
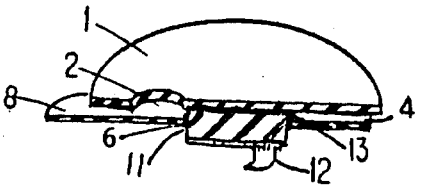

FIG. 6 shows a partial view of the invention, assembled and with protective bottom adhesive cover ready for removal to allow attachment.

Figure 7:
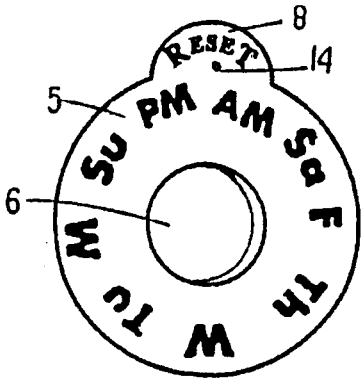

FIG. 7 shows the inner face disc of the invention with the reset tab and letters indicating AM, PM and days of the week.

Figure 8:
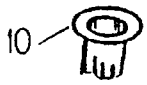

FIG. 8 shows the eyelet anchor means as an alternate to a foam anchor for the invention.

Figure 9:
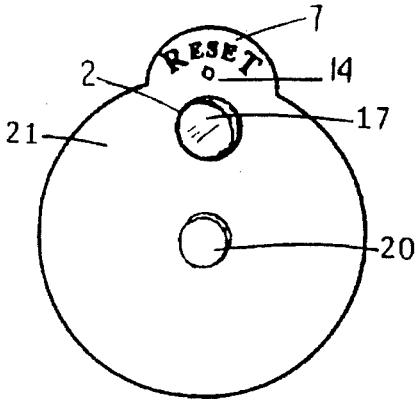

FIG. 9 shows the top window cover, of the invention, providing the reset tab to move freely on the eyelet anchor and a central perforation to receive the eyelet anchor.

Figure 10:
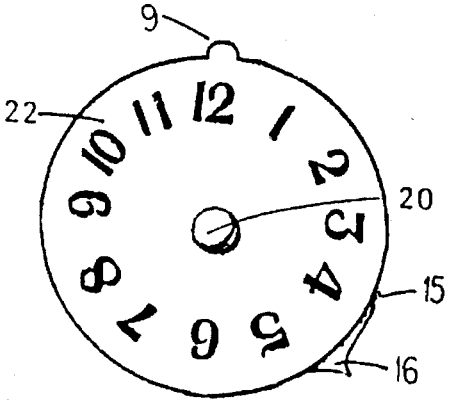

FIG. 10 shows the inner face disc that is adhesive coated on the back to adhere to the cap of a medication container and that provides a central perforation to receive the eyelet anchor and a top outer periphery protrusion to digitally designate the 12 o'clock position to orient with the reset tab on the top window cover.

Figure 11:
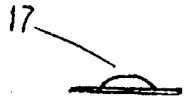

FIG. 11 shows the optional magnifying lens for the top cover window.

Figure 12:
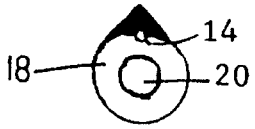

FIG. 12 shows an optional pointer dial with central eyelet perforation to receive the anchor if AM/PM designation is desired printed on the top cover of the invention.

Figure 13:
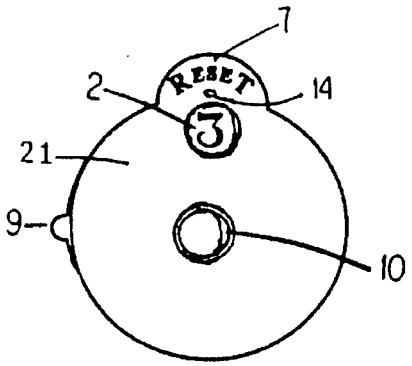

FIG. 13 shows the alternate assembled invention with reset tab on top window cover and anchored with the eyelet.

Figure 14:
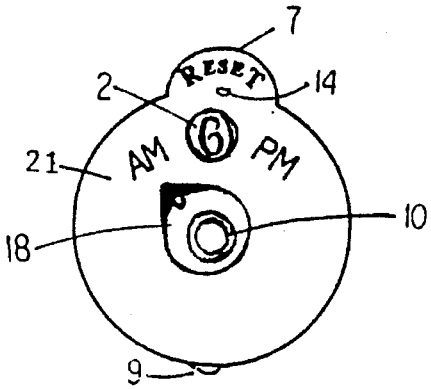

FIG. 14 shows the alternate, assembled invention with reset tab on top window cover and AM/PM pointer dial included in the eyelet anchored dial.

Figure 15:
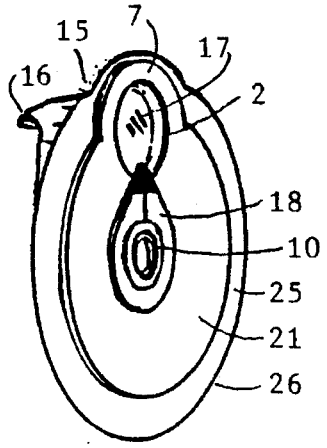

FIG. 15 shows a perspective view of the windowed dial assembled with the optional pointer disc anchored with an eyelet and the adhesive back of the stationary dial face whose imprinted indicia is viewed through the windowed and movable cover disc.

Figure 16:
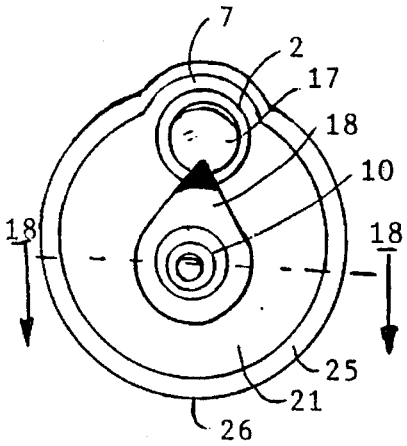

FIG. 16 shows a flat front view of the windowed dial with the optional pointer dial that may be used to indicate AM, PM and days of the week imprinted on the cover disc peripheral front with hourly indicia imprinted on the stationary face of the dial to be viewed through the window of the dial.

Figure 17:
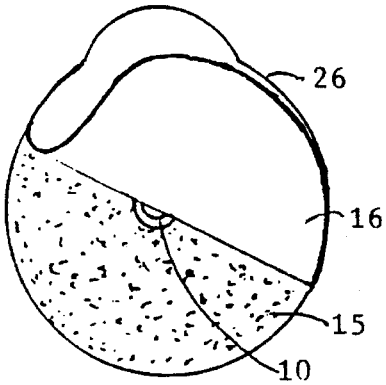

FIG. 17 shows a back view of the dial with the adhesive backing of the eyelet anchored dial assembly to enable adhesion to a medicine container, urine collection bag or other container for monitoring purposes.

Figure 18:
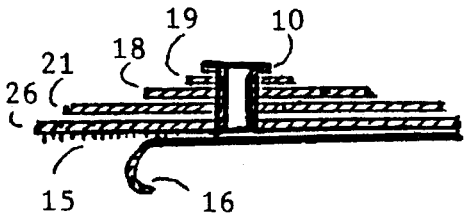

FIG. 18 shows a cross sectional view of the eyelet anchored dial assembly taken along lines 18—18.

Figure 19:
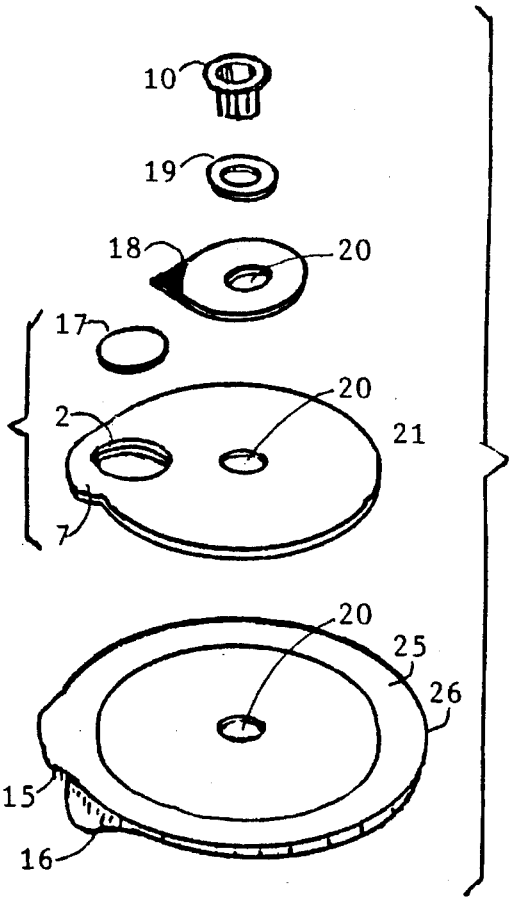

FIG. 19 shows an exploded view of the optional dial assembly.

Figure 20:
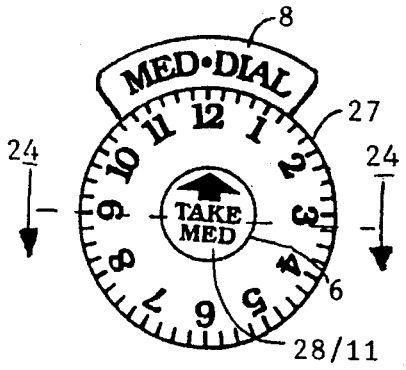

FIG. 20 shows a flat front view of the optional open faced, perforated, movable dial, seated on its adhesive backed anchor, rotatable relative to each other.

Figure 21:
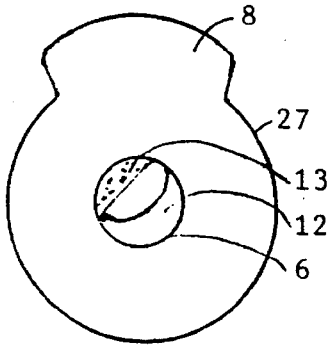

FIG. 21 shows a flat back view of the movable, open faced, indicia imprinted dial and the adhesive anchor.

Figure 22:
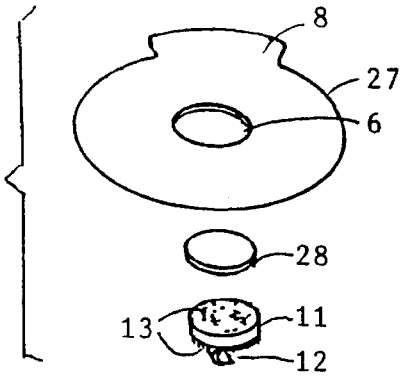

FIG. 22 shows an exploded view of the movable, perforated dial with the printable cap for double coated adhesive foam anchor.

Figure 23:
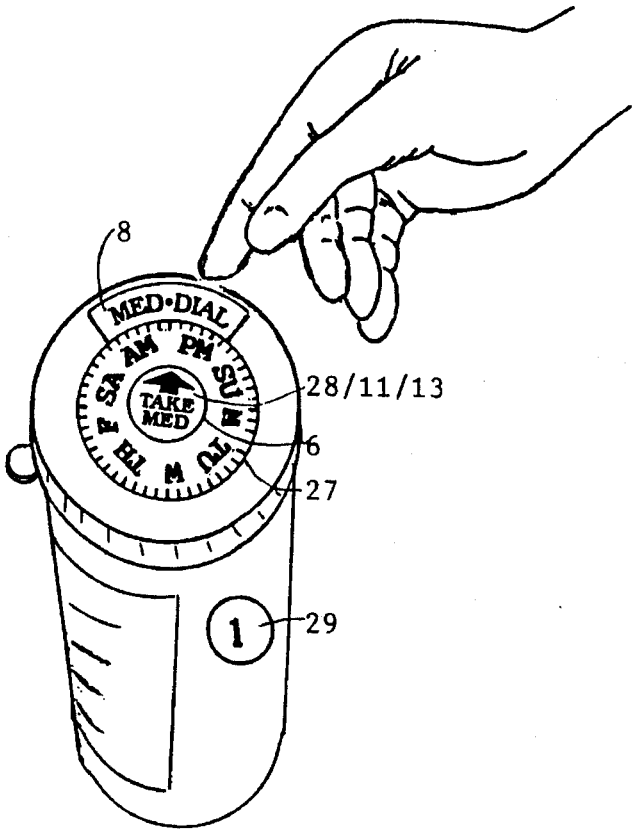

FIG. 23 shows the open faced, indicia imprinted, movable dial with its perforated body seated rotatably on its elevated adhesive anchor, attached to the cap of a numbered medication container.

Figure 24:
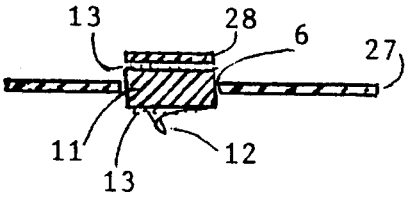

FIG. 24 shows a cross sectional view of the movable dial seated rotatably on the periphery of the capped foam adhesive anchor taken along lines 24—24.

Figure 25:
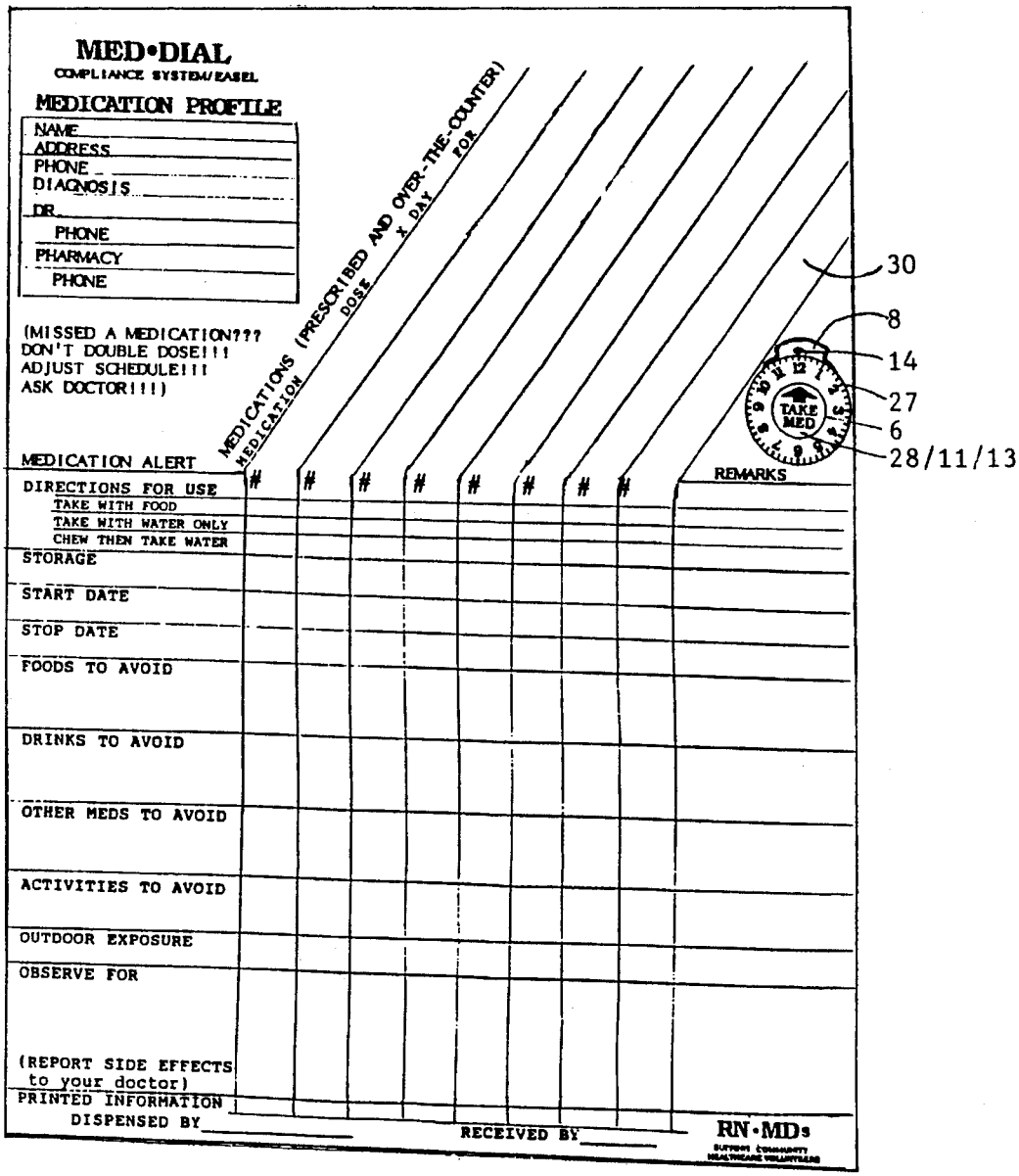

FIG. 25 shows a front view of the medication profile, that comprises an optional time or day dial, to serve as a written record of medication consult to help in compliance with prescribed treatment and to avoid adverse reactions.

Figure 26:
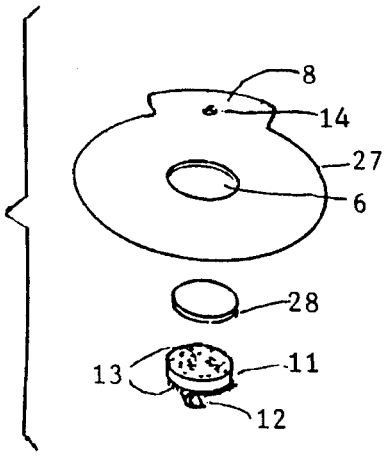

FIG. 26 shows an exploded view of the optional dial adhered to the medication, profile with the movable, perforated dial, the printable cap and the adhesive foam anchor.

Figure 27:
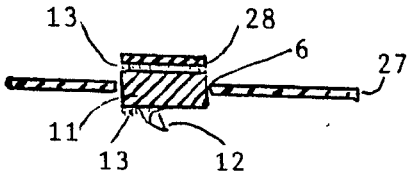

FIG. 27 shows a cross sectional view of the rotatable dial seated on the capped adhesive anchor.

FIG. 28 shows the daily indicia imprinted on the master, magnet or adhesive backed or made a part of an easel structure to provide a more visible monitor dial whose adhesive anchor attaches to the face of the dial with the perforated pointer seated rotatably on the outer periphery of the elevated anchor.

FIG. 29 shows the master dial with hourly indicia imprinted on the stationary face of the dial.

FIG. 30 shows an exploded view of the master dial's pointer and anchor assembly with the adhesive coated magnetized plastic disc to secure the dials in a visible place, if desired.

FIG. 31 shows the elevated back view of the easel structure as a visual aid for the master dials and numbered medications that correspond with the numbered medication containers and comprises punch out dials for the containers.

FIG. 32 shows the front elevated view of the easel visual handicap aid structure with a numbered medication schedule and emergency phone numbers with optional choice of page clips to hold appointment card or printed material for better viewing.

FIG. 33 shows an optional form of the page clip that is partially adhered within the lower structure of the easel.

FIG. 34 shows a front view of the magnifying means for printed material with the telescoping support legs seated into the open end of the magnifier frame.

FIG. 35 shows the telescopic support leg seated into the magnifier structure and its open end poised to be seated onto the vertical end of the page clip.

FIG. 36 shows a partial view of the easel structure where the optional design of a page clip is assembled adhesively, within the walls of the corner of the easel structure.

FIG. 37 shows an optional design for the page clip as a two piece unit to be assembled.

FIG. 38 shows another optional page clip and card or reading material as a two piece structure to be assembled.

FIG. 39 shows another optional page clip as a one piece structure to hold pages or cards or other printed matter.

Figure 40:
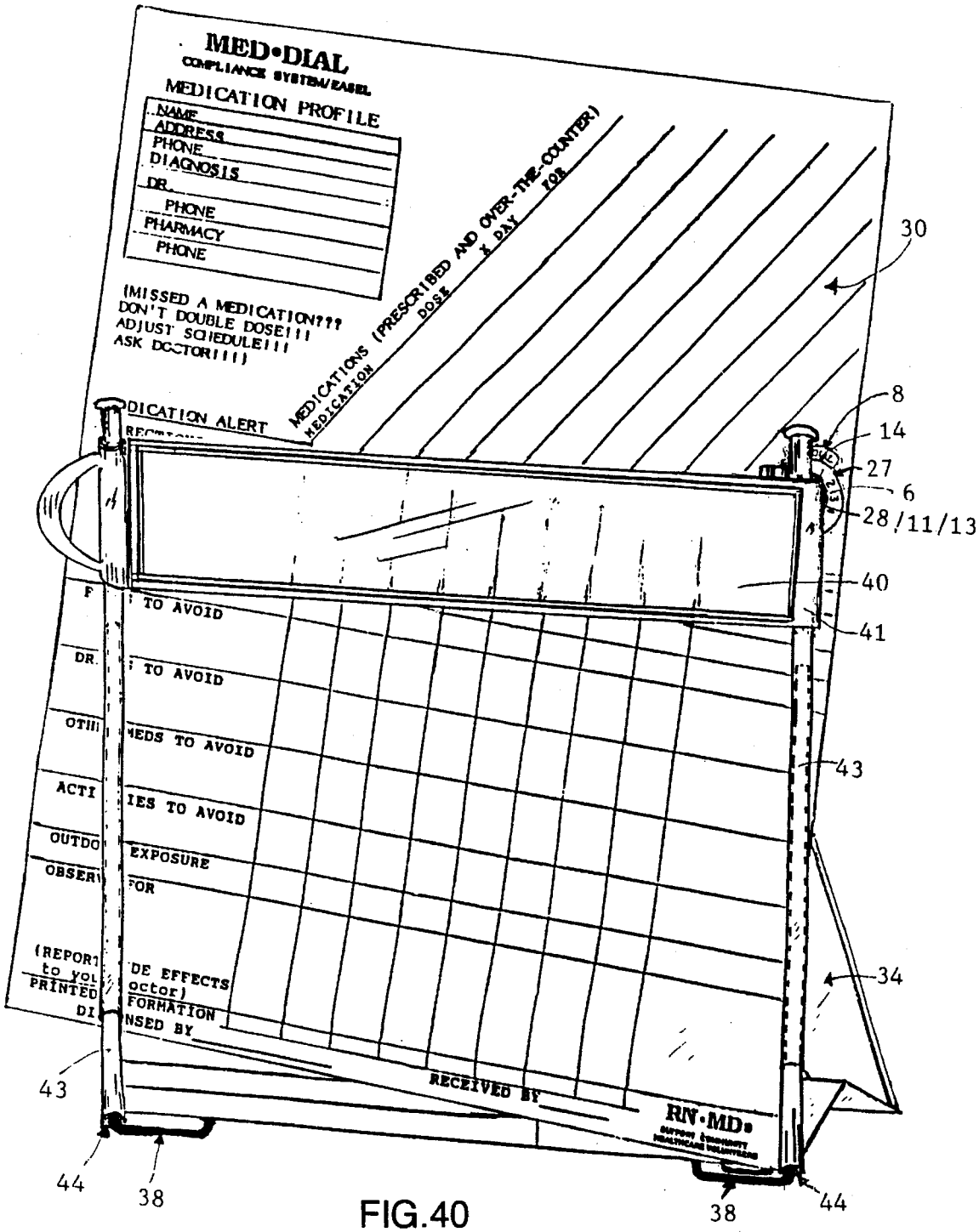

FIG. 40 shows a front elevational view of the assembled easel, page clips, magnification means and support legs with reading matter ready to be positioned to assist the visually handicapped in complying with medication schedule.

DETAILED DESCRIPTION OF THE PREFERRED EMBODIMENTS

Figure 1:
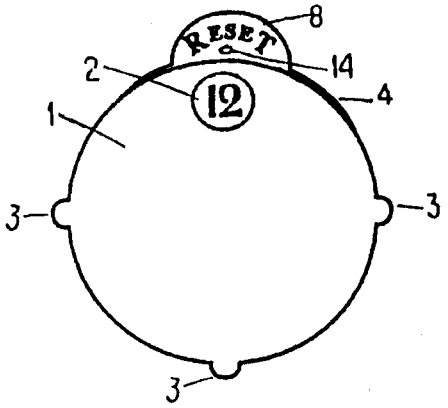
FIG. 1 shows a flat view of the assembled present invention using a central anchor of 2 way adhesive foam around which the reset face disc's central perforation rotates, gripping side of foam disc.
Figure 2:
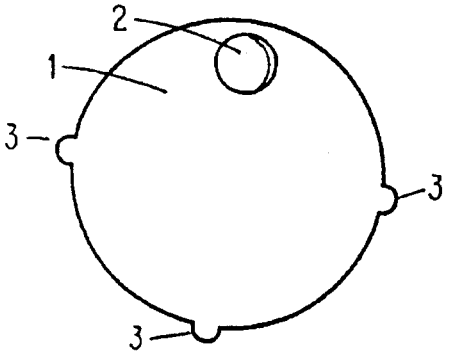
FIG. 2 shows a flat view of the top window cover of the invention with outer peripheral protrusions at 3, 6, and 9 o'clock positions to orient digital feel of reset tab position with view in window.

Referring now to FIG. 1, there is shown a top flat view of the assembled medication time dial. As illustrated therein, FIG. 1 comprises three components, namely a dial cover 1, face 4 and an anchor 11 of double coated adhesive foam, disc shaped. The dial cover 1, as shown in FIG. 2, has outer peripheral protrusions 3 at the clock-like settings of 3, 6 and 9 O'clock to assist the visually handicapped clients in digitally orienting the position of the movable reset tab 8 that coordinates with the time on said face disc 4 viewed in the dial cover 1 window 2. A small perforation 14 is provided in said reset tab 8 for a pointed grip rod to assist the arthritic hand in rotating the reset tab 8 on said face disc 4 shown in FIG. 3. The larger central, perforation 6 of said dial face 4, shown in FIG. 3 fits snugly onto the outer periphery of said first, second or third foam anchor 11, shown in FIG. 4, to allow rotation of said face disc 4 around the body of said foam anchor 11. The exposed adhesive top surface 13 of said foam anchor 11 is centrally adhered to the inner flat body surface of said dial cover 1. The foam anchor 11 provides an adhesive surface 13 on its base for attachment of the medication time dial, as shown in FIG. 1, to the cap of a medication container or other flat surface. A protective peel-off cover 12 is provided for top and bottom adhesive coated surfaces 13 of the foam anchor 11 prior to use.

In FIG. 5 there is shown a perspective view of the three basic components that make up the preferred embodiment of the medication time dial, in position for assembly. The adhesive top surface 13 of said foam anchor 11 is exposed for attachment to the inner, central surface of the cover disc 1, after seating its peripheral surface into large central perforation 6 of said dial face 4.

A perspective, partial view of the assembled, medication time dial is shown in FIG. 6, with the foam anchor 11 centrally adhered to said cover disc 1 and said face disc 4 movably spanning the outer periphery of said foam anchor 11 with its central perforation 6.

The alternate AM/PM/days of the week face disc 5 is shown in FIG. 7, with said larger central perforation 6, said reset tab 8 and said small perforation 14 for grip pointer as shown in FIG. 3 with indicia in counter clock-wise position to allow reset tab 8 to be moved to the right as it advances the medication time, shown in the view window, after medication is taken or treatment performed.

An alternate choice of anchoring the medication time dial is shown in FIG. 8 as an eyelet 10 that can be made of metal or plastic.

FIG. 9 shows a flat view of the alternate dial cover 21 for the eyelet anchored and assembled medication time dials shown in FIG. 13 and FIG. 14. The movable, alternate dial cover 21 provides the central perforation 20 for the eyelet anchor 10, said reset tab 8 with small grip pointer rod perforation 14 and said view window 2. The face disc 22 is adhesive backed 15 for attachment to the cap of a medication container or other flat surface, with a protective cover 16 for safe storage, until ready for use. Said stationary face disc 22 has numerals or letters in a clock-wise direction to allow the movable cover disc 21 to digitally orient its reset tab 8 and view window 2 indicia with the 12 o'clock positioned peripheral protrusion 9 of the face disc 22, for the visually handicapped user. The cover disc 21 is moved to the right to advance to the next medication due time, each time medication is taken, using the reset tab 8 or the grip pointer rod in the reset tab perforation 14.

A magnifying bubble 17 is provided to enhance vision of the indicia. Top and side view of the bubble 17 are shown in FIG. 11 comprising a lip around the base of the bubble to seat under the dial cover view window 2 as the bubble protrudes up through the window opening to lock in place for enhancing the readability of the indicia.

A small, movable pointer dial 18 is shown in FIG. 12 to indicate AM or PM on said dial cover 21. The pointer dial 18 is shown assembled on the medication time dial of FIG. 14. The said pointer dial 18 is anchored with said eyelet 10 through the provided perforations 20 on the pointer dial 18 of FIG. 12, the cover disc 21 of FIG. 9 and through the face disc 22 of FIG. 10 that is adhered to a flat surface leaving said cover disc 21 and said pointer dial 18 movable to advance the view window medication time each time a medication is taken, to avoid the dangers of double dosing or missed medications.

The assembled medication time dial is shown in FIG. 13 as a flat view with the eyelet anchor 10. Said outer peripheral protrusion 9 designates the 12 o'clock position and digitally orients said reset tab 7 at the 3 o'clock position, as shown in the cover disc 21 window 2.

FIG. 14 shows a flat view of the alternate medication time dial assembled with the eyelet anchor 10 and providing said pointer dial 18 to additionally designate AM/PM on the twelve hour said dial cover 21. The peripheral protrusion 9 that designates 12 o'clock on said face disc 22 can digitally orient the position of said reset tab 7 of said cover disc 21 and said pointer dial 18 noted at 6 AM as visually shown by said pointer dial 18 and said view window 2 indicia. The addition of the AM/PM indicia allows the twelve hour dial to cover a twenty four hour period to maintain around the clock medication timing.

An alternative dial assembly, imprinted with time or day indicia, is shown in FIG. 15 and differs in the assembled dial of FIG. 14 by making the windowed 2 rotatable cover disc 21 smaller in diameter to accomodate imprinting safety cap instruction on the outer viewable surface rim 25 of the stationary face disc 26 as further shown in FIG. 16. In FIG. 16 the assembly shows said movable pointer 18 that may be used to indicate AM/PM or other printed matter on the surface of said windowed 2 movable cover disc 21.

A partially exposed adhesive coated, back surface 15 of the face disc 26 with the protective sheet 16 raise, is shown in FIG. 17, in preparation for adhering the dial to the surface of a medication or other container or the surface of a medication profile sheet, to be used in monitoring prescribed treatments or medical procedures.

FIG. 18 is a cross sectional view of the adhesive dial of FIG. 15 and FIG. 16 showing the washer 19 used in the eyelet 10 anchor means to assemble the dial in a freely but grippable manner that prevents the eyelet from crimping into the surface of the pointer 18 disc of the dial.

An exploded view of the dial assembly parts is shown in FIG. 19 with the eyelet 10 poised to intersect the perforations 20 in said washer 19, said pointer disc 18, said windowed 2 movable cover disc 21 and stationary face disc 26. The assembly is anchored together when the eyelet is inserted through said perforations and the eyelet is crimped in the usual manner.

In FIG. 20 there is shown a simplified version of the adhesive dial for containers that comprises time or day indicia imprint 22 with a perforation 6 in the body of the imprinted movable face disc 27 that allows seating the disc 27 onto the periphery of the elevated, button-like foam anchor 11 that has adhesive coated top and base surface 13, and side body surface to allow the face disc of the dial 27 and the adhered anchor to rotate relative to each other. The face dial 27 is digitally rotated by advancing the reset tab 8 that extends out from the periphery at the top of the face disc 27 and the time or day is indicated by a stationary arrow imprinted on the attached foam anchor 11 imprintable cap 29. The diameter of the perforation 6 of the face disc 27 is die cut in a smaller diameter than the die cut of the capped 28 adhesive 13 foam anchor 11 to provide controlled rotation of the face disc 27 and prevent unwanted, accidental movement of the dial or accidental disassembly of the dial when the face disc 27 is grippably seated on the foam anchor 11. The imprintable cap 28 is shown in FIG. 22, in position to be adhered to the adhesive top of the foam anchor 11 or it may be made a part of the adhesive foam after being printed and laminated prior to die cutting the button-like foam anchor discs 11. The assembled anchor 11/cap 28 is seated in the perforation 6 of the face disc 27 the adhesive 13 protective sheet 12 is removed to adhere the dial to a container or other surface. FIG. 22 is an exploded view of the assembly parts of the dial.

FIG. 23 shows said adhesive based anchor 11 attached to the lid of a numbered 29 medication container with said reset tab 8 in position for digital rotation of said rotatable face disc 27 of the dial, to advance the time or day indicia to the next medication due time after each medication dose is taken or procedure is performed to help deter accidental duplication and reinforce the mind-set of prescribed schedules by digitally eyesetting the dial time or day.

In FIG. 24 there is shown a cross sectional view of the dial taken along line 24—24 of FIG. 20 showing the printable cap adhered to the foam anchor 11 and said perforation 6 in the movable face disc 27, of the dial, rotatably spanning the elevated surface periphery of the foam anchor 11.

The compliance system provides a medication profile 30 shown in FIG. 25 to help the consumer, clinician, pharmacist or family organize multiple or single medication and treatment schedules to help avoid the misuse and abuse of drugs and deter potential adverse reactions to the prescribed procedures. A time or day dial may be attached-to the medication profile to help in reminding that a medication or treatment was done or is due to be attended when the dial is reset after each compliance to reinforce the dial time on each medication container, as a double check to deter double dosing or missing medication doses that can delay healing or cause the confusion that initiates emergency room or nursing home admissions. FIG. 26 is an exploded view of the adhesive anchor 11 and printable cap 28 that adheres to the anchor 11. The anchor provides a grippable rotation seat for the face disc 27 perforation 6 and the assembly is shown in a cross sectional view of the dial in FIG. 27.

FIG. 28 and FIG. 29 show the imprinted time and day indicia of the larger, more viewable for the visually handicapped consumer, first and second master dials 31. The master dials 31 are shown with the capped 28 foam anchor 11 adhered to the stationary dial face 24/23. A movable perforated 6 pointer 18 dial is seated on the periphery of the foam anchor 11 to rotate relative to each other when the anchor 11 is adhered to the face of the dial 23/24. The pointer dial has an extended tab to assist in rotation of the dial and an opposing extended tab that is a part of the imprinted arrow of the pointed dial tab. FIG. 30 shows a separated view of the pointer dial 18 with said printable cap 28 for the foam anchor 11. FIG. 30 also shows the adhesive topped 33 magnetized plastic sheet 32 that may optionally be adhered to the back of each master dial or to the back of a card that is imprinted with the master dial faces 31 for attachment to a refrigerator door or other visible place when an adhesive strip replaces the magnet 32, to assist in compliance to treatment schedules.

In FIG. 31 the master dials 31 are imprinted on an easel structure 34. Foam anchors 11 are adhered to the face of the dials 23/24 with the pointer dials 18 seating perforation 6 rotatably on the anchor 11. The easel back provides perforations to punch out dials 27 for attachment to containers with the perforation 6 die cut to receive the capped 28 foam anchor 11 in the printed dial face. The central back of the easel structure 34 has top and sides perforated to allow pushing in the punch out panel into the body of the easel structure 34 to support the easel structure 34 in an upright position and to form a shelf for the medication container to enhance keeping it with the imprinted medication schedule of the easel structure 34 as shown in FIG. 31 and FIG. 32. Number labels may be provided for the medicine containers to correspond with the numbering 29 on the medication schedule 32 and 37 of the easel 34 structure or magnet master card. In FIG. 32 the full medication schedule is shown on the front of the easel structure 34 where the imprint form for emergency phone numbers is provided. A page clip 38 is provided to hold appointment cards and the vertical arm 45 of the page clips 38 can help support other printed matter in a visibly enhanced raised position. Alternate suggested forms of the page clip are shown in FIG. 33, FIG. 37, FIG. 38 and FIG. 39 to allow holding the appointment card in place while using the vertical arm 45 of the page clip 38 for holding the printed matter. The page clips in FIG. 33 and FIG. 36 are partially adhered within the connecting seam 39 of the easel structure 34 front bottom edge that is adhered over an extention of the foldable base of the easel structure 34 where the page clips are anchored by adhesion or the clipping function of the various forms of the page clip body 38 when a slot in the seam of the easel structure 34 is left open to receive the clip on the lower edge of the front bottom edge of the easel structure 34.

FIG. 34 shows a magnifying sheet 40 secured within a frame 41 that embodies a tube-like sliding holder 42 at one end and an open clip-on holder 42 at the other end that allows sliding up and down when the frame slides 42 are seated on telescopic posts 43 whose open bottom end 44 rests onto the vertical extension 45 of the page clips 38 adhesively or clip anchored into the lower corner seams 39 of the easel structure 34 as shown in FIG. 36.

The alternate page clip 38 shown in FIG. 37 and FIG. 38 shows a vertical flat slot 48 in the base to hold the spring-like clip to create grip for the vertical arm 45 spring tension on the material it is intended to hold in aproximation with the easel structure 34.

In FIG. 39 another alternate form of the page clip 38 is shown with the vertical arm 45 made a part of the inner ridged 46 page clip 38 with the page clip 38 extending from the base of the support part of the clip 38. The inner ridges 46 of the body of the page clip 38 interlace with the opposing inner ridges 46 to enhance the grip on pages and improving manufacturing means by easing removal from a mold if the structure is made of a plastic material in one piece.

FIG. 40 is an overall view of the Dial/Easel/Medication Profile Compliance System with visual aids that will enhance the view of the medication profile 30 being inserted behind the framed 41 magnification aid 40 that is supported on telescopic posts 43 that are seated on the vertical extention 45 of the page clips 38 in their base opening 44. The body of the page clips 38 are anchored by adhesion or by clipping into a pocket in the seam of the support easel structure 34. The easel structure 34 enhances visibility of the printed matter to help the visually handicapped and others to deter the glare from lights and to hold the reading matter in a raised position for the arthritic hands. Enhancing visibility of the treatment schedules and organizing medication schedules with digitally set time or day dials, numbering container/schedule and providing master visible dials to help remind consumer that medication was taken and avoid the potential of double dosing or that medication is due to be taken can help avoid adverse consequences of prescribed procedures.

In the foregoing descriptions, specific examples have been used to describe the invention. It is understood by those skilled in the art that certain modifications can be made to these examples without departing from the spirit and scope of the invention.

I claim:

1. A compliance system for medication treatment and procedure schedules comprising:

adhesive backed time or day imprinted small dials for attachment to containers providing a first anchor means on which at least one perforated disc rotates to form a dial assembly, the first anchor means and perforated disc being digitally rotatable relative to each other by means of a peripheral reset tab on the disc to show the next medication or treatment time;

a medication profile providing a visible record of consultation and prescribed treatments;

first large master dials, each comprising a face disc with time or day indicia imprinted thereon and each having a second adhesive anchor means attached thereto and receiving a central opening of a pointer disc on the second anchor means for rotation relative to each other wherein each said large dial may be attached to a support surface by magnet or adhesive applied to the back surface thereof;

an easel, imprinted with second large master dials and a numbered medication schedule whose numbers coordinate with a number label on a medication container when used therewith; such container may be kept on a shelf in the easel, said shelf being formed by pushing down on a partially perforated, central back section, thereby forming the shelf within the easel base, a front lower seam of the easel providing a pocket which receives page clips which hold printed matter; the second master dials each having an attached, elevated third anchor means on which a further pointer disc rotates to designate the time of next procedure, and a magnification means to enhance reading matter that is seated onto a vertical arm of one of the page clips at a base opening thereof in two telescoping support posts on which the magnification means is slidable.

2. The system of claim 1 wherein said dial assembly is secured with an eyelet intersecting a perforation of an adhesive backed face disc, a dial cover including a window and a reset tab for resetting the dial cover to view indicia imprinted on the face disc, the face disc further including at least one visual orientation protrusion on the perimeter thereof; a perforated pointer disc for indicating AM and PM indicia on the face of the dial cover; and a magnifying lens held in the window of the dial cover to enhance viewing of the indicia.

3. The system of claim 1 wherein said dial assembly is secured with the first anchor means which includes an adhesive coated foam disc having thereon a cap which includes a stationary, windowed dial cover wherein said anchor means rotatably intersects a perforation of a face disc and may be adhered by the adhesive coating to a container to monitor treatment schedules; the system further including a grippable reset tab provided on the periphery of the movable face disc with imprinted indicia of the face disc viewable through a stationary window of said dial cover, wherein the dial cover may provide peripheral protrusions to indicate the positions of three, six and nine o'clock on said face disc to assist the visually handicapped in orienting the face disc.

4. The system of claim 3 wherein said cap is a printable disc to allow open viewing of the indicia imprinted on the face disc including an arrow indicator for resetting the time imprinted on the cap and adhered to the adhesive of said first anchor means on which the perforation of the face disc is seated for rotation, the first anchor means being of the same diameter as said cap but made from material more rigid than the cap to deter accidental disengagement of the assembly.

5. The system of claim 1 wherein the medication profile includes an attached adhesive dial having a perforated face disc seated rotatably onto said first anchor means which is capped with an arrow imprinted cap of the same diameter as the first anchor means wherein the cap and the anchor means are of slightly larger diameter than the perforation of the face disc to provide grippable rotation to deter accidental rotation.

6. The system of claim 1 wherein said first master dials are imprinted onto a magnetic or adhesive backed card that provides peel off number labels for medication containers, and said easel includes a numbered medication schedule form with said second master dials displaying hourly and daily indicia to help organize multiple medication schedules.

7. The system of claim 1 wherein said page clips grip the lower seam of the easel and are secured in place by interwoven ribs on an inner surface of vertical grip arms of each clip with a spring part of each clip extending from the base of the grip arms, bending down and parallel to the clip base and bending again to form a vertical extended arm of the support for said telescoping posts of the magnification means for the easel.

8. The system of claim 2 wherein said dial face includes a small perforation in the reset tab to assist in rotating the disc with a grippable pointer rod when resetting the scheduled time.

9. The system of claim 2 wherein said dial assembly also includes an eyelet washer to protect the top surface of the movable pointer dial.

10. The system of claim 1 wherein the central back perforated section comprises additional dials that are die cut to provide a perforated body and perforated periphery to allow punching out ot the dials and insertion of the first anchor means to adhere the dials to a container.

* * * * *